US010544642B2

(12) United States Patent
Bhatnagar

(10) Patent No.: US 10,544,642 B2
(45) Date of Patent: Jan. 28, 2020

(54) ADJUSTABLE LOCK-OUT RAM FOR PRODUCTION BOP APPLICATIONS

(71) Applicant: GE Oil & Gas Pressure Control LP, Houston, TX (US)

(72) Inventor: Samved Bhatnagar, Houston, TX (US)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 92 days.

(21) Appl. No.: 15/204,608

(22) Filed: Jul. 7, 2016

(65) Prior Publication Data

US 2017/0009549 A1 Jan. 12, 2017

Related U.S. Application Data

(60) Provisional application No. 62/190,982, filed on Jul. 10, 2015.

(51) Int. Cl.
*E21B 33/06* (2006.01)

(52) U.S. Cl.
CPC ..... *E21B 33/062* (2013.01)

(58) Field of Classification Search
CPC ..... E21B 33/062; E21B 43/126
See application file for complete search history.

(56) References Cited

U.S. PATENT DOCUMENTS 2,527,068 A * 10/1950 Murray ..... E21B 33/062 277/325
4,398,729 A * 8/1983 Bishop ..... E21B 33/062 251/1.3
4,576,067 A * 3/1986 Buck ..... E21B 19/161 269/283
5,009,289 A * 4/1991 Nance ..... E21B 19/10 188/67
5,127,623 A * 7/1992 McDugle ..... E21B 33/062 251/1.3
5,294,088 A * 3/1994 McWhorter ..... E21B 33/062 251/1.3

(Continued)

FOREIGN PATENT DOCUMENTS

CA 2291358 A1 6/2001

OTHER PUBLICATIONS

PCT Search Report and Written Opinion issued in connection with corresponding PCT Application No. PCT/US2016/041487 dated Oct. 26, 2016.

*Primary Examiner* — Matthew R Buck
(74) *Attorney, Agent, or Firm* — Hogan Lovells US LLP

(57) ABSTRACT

Systems and methods for gripping a polished rod that extends into a hydrocarbon production well include a clamping assembly that is moveable between an unengaged position where the clamping assembly is spaced apart from the polished rod, and an engaged position where the clamping assembly engages the polished rod. The clamping assembly includes a recess located in a moveable clamping member, the recess having a supporting surface. The clamping assembly also includes an adapter sized to fit within the recess and to be supported on the supporting surface, the adapter having a gripping surface facing out of the recess. The adapter is positioned to grip the polished rod with the gripping surface when the clamping assembly is in the engaged position.

20 Claims, 4 Drawing Sheets

(56) References Cited

U.S. PATENT DOCUMENTS

| | | | | | |
|---|---|---|---|---|---|
| 5,603,481 | A * | 2/1997 | Parker | E21B 33/062 | 251/1.3 |
| 5,833,208 | A * | 11/1998 | Lee, Jr. | E21B 33/062 | 251/1.1 |
| 5,944,110 | A * | 8/1999 | Watts | E21B 33/062 | 166/320 |
| 6,223,819 | B1 * | 5/2001 | Heinonen | E21B 33/068 | 166/368 |
| 6,543,546 | B2 * | 4/2003 | Kaiser | E21B 41/0021 | 166/382 |
| 6,595,278 | B1 * | 7/2003 | Lam | E21B 19/06 | 166/68.5 |
| 7,000,888 | B2 * | 2/2006 | Wright | E21B 19/12 | 251/1.1 |
| 7,125,195 | B2 * | 10/2006 | Hagen | E21B 19/161 | 403/381 |
| 7,137,610 | B2 * | 11/2006 | Lam | E21B 33/062 | 251/1.3 |
| 7,270,190 | B2 * | 9/2007 | McWhorter | E21B 33/062 | 166/382 |
| 7,673,674 | B2 * | 3/2010 | Lam | E21B 19/12 | 166/75.11 |
| 2008/0078965 | A1 * | 4/2008 | Lane | E21B 19/12 | 251/1.3 |
| 2015/0184481 | A1 * | 7/2015 | Painter | E21B 33/062 | 251/1.3 |

* cited by examiner

ADJUSTABLE LOCK-OUT RAM FOR PRODUCTION BOP APPLICATIONS

CROSS REFERENCE TO RELATED APPLICATION

This application claims priority to and the benefit of U.S. Provisional Application Ser. No. 62/190,982, filed Jul. 10, 2015, titled "Adjustable Lock-Out Ram For Production BOP Applications," the full disclosure of which is incorporated herein by reference in its entirety for all purposes.

BACKGROUND

1. Field of the Disclosure

This disclosure relates in general to assemblies for gripping polished rods in hydrocarbon production operations, and in particular to interchangeable adapters with gripping surfaces for use in such assemblies.

2. Description of Related Art

During some hydrocarbon production operations, a drive can be used to rotate a polished rod that extends into a subterranean well. The rotating polished rod in turn drives a pump that provides lift to fluids that are within the subterranean well and can be used to force such fluids to the surface and be produced into a flow line. Such a production system can be used, for example, with a steam assisted gravity drainage process, which is undertaken at high temperatures.

In order to perform service on the production system that requires the polished rod to be locked in a non-rotating condition, a gripping surface of a piston ram can engage the polished rod. The piston rams can be part of a lock-out device, or can part of a blowout preventer (BOP) that has one or more sets of rams with various functions. When in the closed position the piston rams can clamp around the polished rod and secure the rod string. In certain embodiments, the piston rams can also seal off the well bore. The sealing function and gripping function can be carried out by a single set of rams. The clamping action of the piston rams reduces environmental and safety risks while performing services on the production system.

The polished rods used to drive the pump can have different diameters, depending on the make, model, and size of pump that is being run downhole. Therefore, the piston ram gripping surface and polished rod clamp gripping surface will both need to be properly sized to fully engage and grip the polished rod of the specific size used in the particular production operation. The gripping surfaces must provide a sufficient grip to both support the weight of the rod string and pump, as well as resist any rotation or torque applied to the polished rod. If the pump is replaced with a new pump that requires a different sized polished rod, the gripping surfaces for the polished rod clamp and the piston ram may not properly grip the new polished rod and will need to be resized. There may also be times when the gripping surfaces of the polished rod clamp and the piston ram become worn and need to be replaced.

SUMMARY OF THE DISCLOSURE

Embodiments of this disclosure describe systems and methods for providing replaceable adapters with gripping surfaces of various sizes in the piston ram and polished rod clamp. Embodiments of the adapters described herein provide time and cost savings compared to current systems, where the entire piston ram would need to be replaced. The adapters described herein are also lighter and would result in less scrap material over the life of the production operation compared to such current systems. Operators can have a series of adapters on hand that could be utilized for different polished rod sizes as specified per API Spec 11B, without investing as much money or using as much storage space as maintaining the required replacement parts of some current systems. Systems and method described herein therefore provide reduced costs and improved serviceability for production systems that utilized polished rods.

In an embodiment of the current disclosure, a system for gripping a polished rod that extends into a hydrocarbon production well includes a clamping assembly that is moveable between an unengaged position where the clamping assembly is spaced apart from the polished rod, and an engaged position where the clamping assembly engages the polished rod. The clamping assembly includes a recess located in a moveable clamping member, the recess having a supporting surface. The clamping assembly also includes an adapter sized to fit within the recess and to be supported on the supporting surface, the adapter having a gripping surface facing out of the recess. The adapter is positioned to grip the polished rod with the gripping surface when the clamping assembly is in the engaged position.

In an alternate embodiment of the current disclosure, a system for gripping a polished rod that extends into a hydrocarbon production well includes a clamping assembly of a blowout preventer that is moveable between an unengaged position where the clamping assembly is spaced apart from the polished rod, and an engaged position where the clamping assembly engages the polished rod. The clamping assembly includes a pair of piston rams extendable into a central bore of the blowout preventer when the clamping assembly is in the engaged position. The clamping assembly also includes at least one recess located in each piston ram, each of the at least one recesses having a supporting surface. An adapter is sized to fit within each of the at least one recesses and to be supported on the supporting surface. The adapter has a gripping surface facing out of the recess. The adapter is positioned to grip the polished rod with the gripping surface when the clamping assembly is in the engaged position.

In yet another alternate embodiment of the current disclosure, a method for gripping a polished rod that extends into a hydrocarbon production well includes providing a clamping assembly that has: a recess located in a moveable clamping member, the recess having a supporting surface; and an adapter sized to fit within the recess and to be supported on the supporting surface. The adapter has a gripping surface facing out of the recess. The clamping assembly is moved between an unengaged position where the clamping assembly is spaced apart from the polished rod, and an engaged position where the clamping assembly engages the polished rod so that the adapter grips the polished rod with the gripping surface.

BRIEF DESCRIPTION OF DRAWINGS

Some of the features and benefits of the present disclosure having been stated, others will become apparent as the description proceeds when taken in conjunction with the accompanying drawings, in which.

Figure 1:
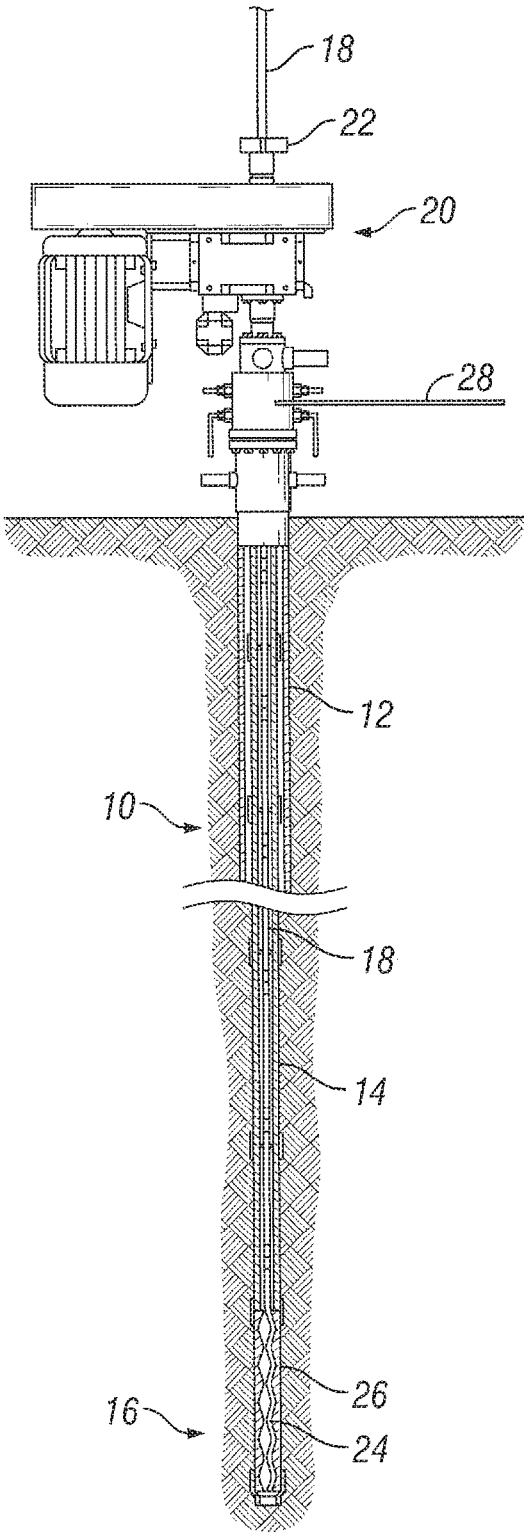
FIG. 1 is a schematic section view of a hydrocarbon production well with a clamping assembly in accordance with an embodiment of this disclosure.

While the disclosure will be described in connection with the example embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION OF DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, well 10 is a subterranean well used in hydrocarbon development and production operations. Well 10 can include a production system with a steam assisted gravity drainage process, which is undertaken at high temperatures. In alternate embodiments, well 10 can be produced with other known types of systems that utilize a rotating polished rod that extends into well 10.

Well 10 can have a casing 12 and production tubing 14 extending into the well through casing 12. In order to provide lift to fluids within well 10 so that such fluids are produced to the surface, pump 16 can be located within production tubing 14 of well 10. Pump 16 can be powered by a rotating rod such as polished rod 18 that extends through production tubing 14 to pump 16. Polished rod 18 can be rotated by drive unit 20 that is located at the surface outside of well 10. Polished rod 18 extends through drive unit 20 and can be supported by polished rod clamp 22.

In the example of FIG. 1, pump 16 is a progressive cavity pump that includes rotor 24 which rotates within stator 26. An end of polished rod 18 is attached to rotor 24 for rotating rotor 24 within stator 26. In alternate embodiments, an alternate pump known in the industry that is powered by a rotating rod can be used.

Blowout preventer 28 can be located above well 10 and be in fluid communication with production tubing 14. Polished rod 18 extends through a central bore 27 of blowout preventer 28. Looking at FIG. 2, blowout preventer 28 can have one or more sets of piston rams 30. Piston rams 30 can be used to seal around polished rod 18 and clamp polished rod 18 to prevent rotation of polished rod 18. The sealing function of blowout preventer 28 can seal the well bore so that fluids cannot escape out of well 10 past blowout preventer 28. The clamping function of blowout preventer 28 can reduce environmental and safety risks while performing services on the production system.

Figure 2:
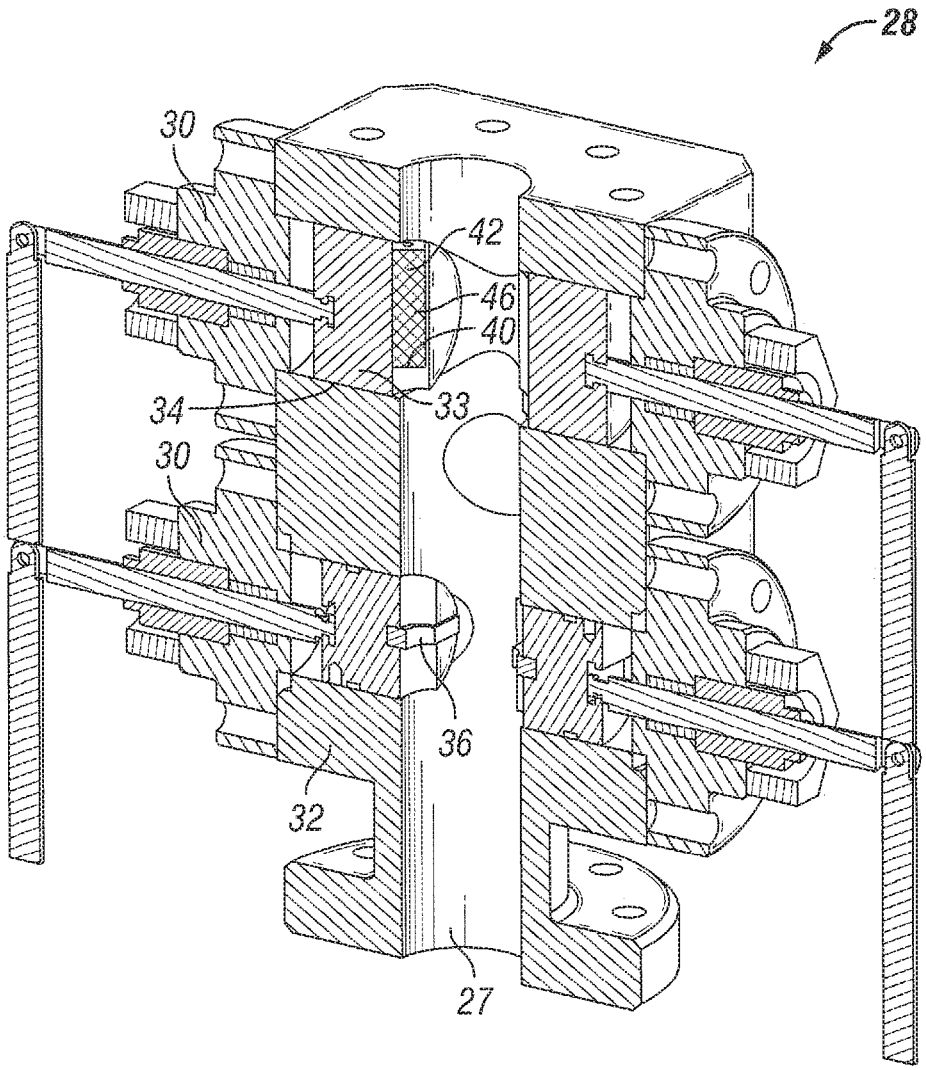
FIG. 2 is a perspective section view of a blowout preventer with a clamping assembly in accordance with an embodiment of this disclosure.

In certain embodiments, the sealing and clamping functions can be provided by a single set of piston rams 30. In the example embodiment of FIG. 2, blowout preventer 28 has separate sealing assembly 32 and clamping assembly 34. In the example of FIG. 2, sealing assembly 32 includes two piston rams 30 that are located on opposite sides of central bore 27 and extend radially in to central bore 27 to seal around polished rod 18. Seal members 36 of sealing assembly 32 can have a portion that forms a seal around polished rod 18 and a portion that seals against the opposite facing seal member 36 so that fluids can not flow through central bore 27 past sealing assembly 32.

In the example of FIG. 2, clamping assembly 34 includes two piston rams 30. Each piston ram 30 have ram blocks 33 that are moveable clamping members positioned on opposite sides of central bore 27. Clamping assembly 34 is moveable between an unengaged position where clamping assembly 34 is spaced apart from the polished rod (as seen in FIG. 2), and an engaged position where clamping assembly 34 engages polished rod 18. In order to move clamping assembly 34 between an unengaged position and an engaged position, ram blocks 33 are extended into central bore 27 of blowout preventer 28.

Figure 3:
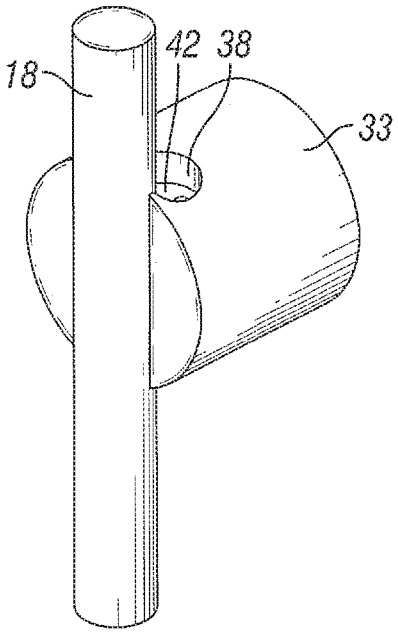
FIG. 3 is a perspective view of the ram block and adapters of FIG. 2, shown engaging a polished rod.
Figure 4:
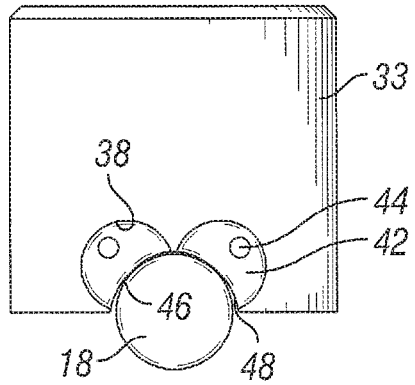
FIG. 4 is a top plan view of the ram block and adapters of FIG. 2, shown engaging a polished rod.
Figure 5:
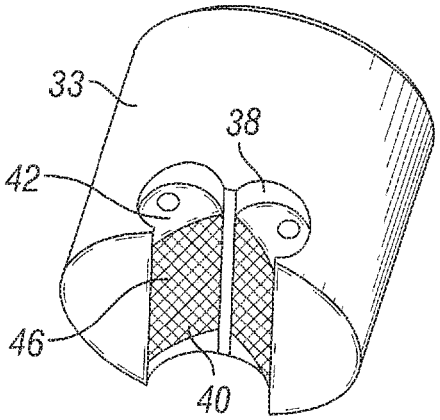
FIG. 5 is a perspective view of the ram block and adapters of FIG. 2.

Looking at FIGS. 3-5, each ram block 33 has recess 38. Recess 38 is located in a face of ram block 33 that faces towards central bore 27. Each ram block 33 can have one recess or can have additional recesses 38. In the example embodiments shown, ram block 33 has two recesses 38. Recess 38 has supporting surface 40 at a lower end and an open end opposite supporting surface 40.

Each recess 38 can house adapter 42. Therefore where there is one recess 38 there can be one adapter 42 and where there are additional recesses 38 there can be additional adapters 42. Adapter 42 is sized to fit within recess 38 and to be supported on supporting surface 40. Adapter 42 can be formed of hardened steel, tungsten carbide, or other suitable material known in the art.

Adapter 42 can be releasably secured to ram block 33 with fastener 44. Fastener 44 in the examples shown extends axially through adapter 42 and can be accessed through the open end of recess 38. Fastener 44 extends between adapter 42 to ram block 33. Fastener 44 allows for limited relative movement between adapter 42 and ram block 33. Fasteners 44 can be, for example, threaded members that pass through adapter 42 and thread into ram block 33. The opening in adapter 42 through which fastener 44 passes can be larger than an outer diameter of fastener 44 to allow for some relative movement between adapter 42 and ram block 33. Adapters 42 are removable from the piston rams 30 by removing fasteners 44 from ram block 33.

Adapter 42 has gripping surface 46. Gripping surface 46 faces out of recess 38 and adapter 42 is positioned within recess 38 so that adapter 42 grips polished rod 18 with gripping surface 46 when clamping assembly 34 is in the engaged position. Gripping surface 46 can have, for example, carburized teeth, a helical thread shape, concentric protrusions, or other shape of gripping features that maximizes the friction between gripping surface 46 and polished rod 18 and enables gripping of polished rod 18 by adapter 42. In the example of FIG. 5, a diagonally patterned gripping surface 46 is shown.

Gripping surface 46 can also have profile shape 48 configured to mate with an outer diameter surface of polished rod 18. As can be seen in FIG. 4, profile shape 48 can be a curved surface to maximize the contact between gripping surface 46 and polished rod 18. Profile shape 48 can be selected according to the polished rod diameters, tolerances, torque and hang off requirements of a particular development. In certain embodiments, profile shape 48 of a single gripping surface 46 can accommodate a variety of diameters of polished rod 18. In alternate embodiments, profile shape 48 can be shaped to accommodate a single size of polished rod 18. Gripping surface 46 provides a sufficient grip to both support the weight of polished rod 18 and pump 16. Gripping surface 46 used in blowout preventer 28 must also resist any rotation or torque applied to polished rod 18.

Because adapter 42 can be held axially in place with fasteners 44 that allow for some relative movement radially between adapter 42 and ram block 33, adapter 42 can move a limited amount to position around polished rod 18 to form and maintain a grip on polished rod 18. Fasteners 44 will not take a load of polished rod 18. The load of polished rod 18 will instead be transferred from adapters 42 to clamping assembly 34 by way of supporting surface 40 and sidewalls of recess 38.

Figure 6:
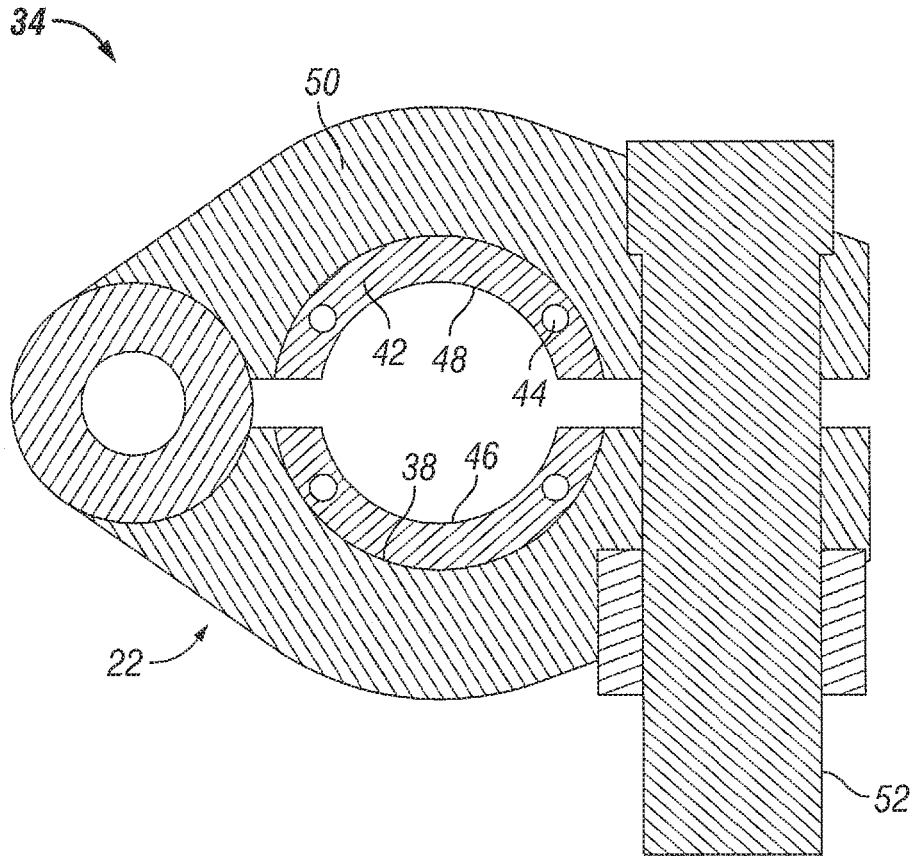
FIG. 6 is a cross sectional view of a polished rod clamp with a clamping assembly in accordance with an embodiment of this disclosure.

Polished rod clamp 22 is also located above well 10 and includes clamping assembly 34 for supporting pump 16. Looking at FIG. 6, polished rod clamp 22 can also include moveable clamping members in the form of clamp arms 50. In such an embodiment, moving clamping assembly 34 between an unengaged position and an engaged position includes surrounding polished rod 18 with the clamp arms 50 of polished rod clamp 22. A securing member 52 can hold the ends of clamp arms 50 together so that clamping assembly 34 remains in an engaged position.

Each clamp arm 50 has recess 38. Recess 38 is located in a face of clamp arm 50 that faces towards the opposite clamp arm 50. Each clamp arm 50 can have one recess or can have additional recesses 38. In the example embodiment shown, each clamp arm 50 has one recess 38. Recess 38 houses adapter 42. Adapter 42 has the features discussed herein and is supported in recess 38 as discussed herein in relation to ram block 33.

In an example of operation, in order to secure polished rod 18 with clamping assembly 34, clamping assembly 34 is moved from the unengaged position to the engaged position so that adapter 42 grips polished rod 18 with gripping surface 46. In the example of using clamping assembly 34 of blowout preventer 28, an operator may wish to perform service on the production system that requires the polished rod 18 to be locked in a non-rotating condition. In the example of using clamping assembly 34 of polished rod clamp 22, the operator can use polished rod clamp 22 to suspend and support polished rod 18 within well 10.

The polished rod 18 used to drive pump 16 can have different diameters, depending on the make, model, and size of pump 16 that is being run downhole. Therefore, gripping surface 46 will need to be properly sized to fully engage and grip polished rod 18 of the specific size used in the particular production operation. If pump 16 is replaced with a new pump that requires a different sized polished rod 18, gripping surfaces 46 may not properly grip the new polished rod 18 and gripping surfaces 46 of both blowout preventer 28 and polished rod clamp 22 will need to be resized. There may also be times when gripping surfaces 46 of become worn and need to be replaced.

In order to remove and replace adapter 42, fasteners 44 can be removed, adapters 42 can be removed, and new adapter 42 can be releasably secured with fasteners 44. Recess 38 is shaped and sized to accept adapters 42 of various sizes so that the adapters 42 can be selected to grip the required size of polished rod 18. In this way, the entire blowout preventer 28 or polished rod clamp 22 does not need to be replaced when the polished rod 18 changes size. Instead, the adapter 42 of the correct size can be inserted into recess 38.

Where reference is made to a method comprising two or more defined steps, the defined steps can be carried out in any order or simultaneously except where the context excludes that possibility. The terms "vertical", "horizontal", "upward", "downward", "above", and "below" and similar spatial relation terminology are used herein only for convenience because elements of the current disclosure may be installed in various relative positions.

The present disclosure described herein, therefore, is well adapted to carry out the objects and attain the ends and advantages mentioned, as well as others inherent therein. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

What is claimed is:

1. A system for gripping a polished rod that extends into a hydrocarbon production well, the system comprising:

a clamping assembly that is moveable between an unengaged position where the clamping assembly is spaced apart from the polished rod, and an engaged position where the clamping assembly engages the polished rod to clamp the rod in place, but does not seal against the rod, the clamping assembly including:

a recess located in a moveable clamping member, the moveable clamping member having a supporting surface at a lower end of the recess, the recess having an open end opposite the supporting surface; and an adapter sized to fit within the recess, wherein the adapter is inserted into the open end and supported on the supporting surface, the adapter having a gripping surface facing out of the recess, the adapter unconstrained by an interface between the moveable clamping member and the adapter from relative circumferential movement relative to the clamping member; and wherein the adapter is positioned to grip the polished rod with the gripping surface when the clamping assembly is in the engaged position.

2. The system of claim 1, further comprising a fastener extending between the adapter and the moveable clamping member, the fastener releasably securing the adapter to the moveable clamping member and allowing for limited relative circumferential movement between the adapter and the moveable clamping member.

3. The system of claim 2, wherein the fastener is oriented axially substantially parallel to the polished rod.

4. The system of claim 1, wherein the moveable clamping member is a ram block of a blowout preventer.

5. The system of claim 1, wherein the moveable clamping member is a clamp arm of a polished rod clamp.

6. The system of claim 1, wherein the gripping surface has a profile shape, the profile shape configured to mate with an outer diameter surface of the polished rod.

7. The system of claim 6, wherein the gripping surface has gripping features, the gripping features selected from the group consisting of carburized teeth, a helical thread shape, and concentric protrusions.

8. The system of claim 1, wherein the clamping assembly includes at least two moveable clamping members.

9. The system of claim 1, wherein the moveable clamping member has an additional recess and an additional adapter is positioned within the additional recess.

10. A system for gripping a polished rod that extends into a hydrocarbon production well, the system comprising:

a clamping assembly of a blowout preventer that is moveable between an unengaged position where the clamping assembly is spaced apart from the polished rod, and an engaged position where the clamping assembly engages the polished rod to clamp the rod in place, but does not seal against the rod, the clamping assembly including:

a pair of piston rams extendable into a central bore of the blowout preventer when the clamping assembly is in the engaged position;

at least one recess located in each piston ram, each of the pair of piston rams having a supporting surface at a lower end of the at least one recess, and the at least one recess having an open end opposite the supporting surface; and an adapter sized to fit within each of the at least one recesses, wherein the adapter is inserted into the open end and supported on the supporting surface, each adapter having a gripping surface facing out of the recess, the adapter unconstrained by an interface between the adapter and a corresponding piston ram from relative circumferential movement relative to the piston ram; and wherein each adapter is positioned to grip the polished rod with the gripping surface when the clamping assembly is in the engaged position.

11. The system of claim 10, further comprising a fastener extending between each of the adapters and the piston rams, each fastener releasably securing the adapter to the piston ram and allowing for limited relative circumferential movement between the adapter and the piston ram.

12. The system of claim 10, wherein each of the adapters is removable from the piston ram.

13. The system of claim 10, wherein the gripping surface has a profile shape, the profile shape configured to mate with an outer diameter surface of the polished rod.

14. A method for gripping a polished rod that extends into a hydrocarbon production well, the method comprising:

providing a clamping assembly that includes a recess located in a moveable clamping member, the clamping member having a supporting surface at a lower end of the recess, the recess having an open end opposite the supporting surface, and an adapter sized to fit within the recess, wherein the adapter is inserted into the open end and supported on the supporting surface, the adapter having a gripping surface facing out of the recess, the adapter unconstrained by an interface between the moveable clamping member and the adapter from relative circumferential movement relative to the clamping member; and moving the clamping assembly between an unengaged position where the clamping assembly is spaced apart from the polished rod, and an engaged position where the clamping assembly engages the polished rod so that the adapter grips the polished rod with the gripping surface to clamp the rod in place, but does not seal against the rod.

15. The method of claim 14, further comprising releasably securing the adapter to the moveable clamping member with a fastener that extends between the adapter and the moveable clamping member, the fastener allowing for limited relative circumferential movement between the adapter and the moveable clamping member.

16. The method of claim 14, wherein the moveable clamping member is a ram block of a blowout preventer and moving the clamping assembly between the unengaged position and the engaged position includes extending the ram block into a central bore of the blowout preventer.

17. The method of claim 14, wherein the moveable clamping member is a clamp arm of a polished rod clamp and moving the clamping assembly between the unengaged position and the engaged position includes surrounding the polished rod with the polished rod clamp.

18. The method of claim 14, wherein moving the clamping assembly between the unengaged position and the engaged position further includes mating a profile shape of the gripping surface with an outer diameter surface of the polished rod.

19. The method of claim 14, further comprising forming a load path from the polished rod through the adapter and to the clamping assembly by way of the supporting surface and sidewalls of the recess.

20. The method of claim 14, further comprising removing the adapter from the recess and replacing the adapter with a replacement adapter.

* * * * *